US006373183B1

(12) United States Patent
Bae

(10) Patent No.: US 6,373,183 B1
(45) Date of Patent: Apr. 16, 2002

(54) FUNNEL HAVING VERTICALLY LONG NECK PORTION

(75) Inventor: Sung-ryong Bae, Yangsan (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/460,711

(22) Filed: Dec. 14, 1999

(30) Foreign Application Priority Data

| | | |
|---|---|---|
| Dec. 15, 1998 | (KR) | 98-55030 |
| Dec. 23, 1998 | (KR) | 98-57683 |
| Dec. 23, 1998 | (KR) | 98-57684 |

(51) Int. Cl.[7] ..... H01J 31/00

(52) U.S. Cl. ..... 313/477 R; 220/2.1 R; 220/2.1 A

(58) Field of Search ..... 313/477 R; 220/2.1 R, 220/2.3 A, 2.1 A

*Primary Examiner*—Vip Patel
(74) *Attorney, Agent, or Firm*—Lowe Hauptman Gilman & Berner, LLP

(57) ABSTRACT

A funnel for a cathode ray tube, and a cathode ray tube including the funnel are provided. The funnel includes a neck portion whose cross section is vertically long, a first cone portion which extends from the neck portion such that the cross section is vertically long as the neck portion, and is surrounded by a deflection yoke, and a second cone portion which extends from the first cone portion to be enlarged and meets a panel.

6 Claims, 6 Drawing Sheets

FUNNEL HAVING VERTICALLY LONG NECK PORTION

BACKGROUND OF THE INVENTION

1. Field of the Invention

The present invention relates to a cathode ray tube (CRT), and more particularly, to a funnel having a neck portion in which an in-line electron gun is installed, and a cathode ray tube adopting the same.

2. Description of the Related Art

Referring to FIG. 1, a typical CRT includes a panel 12 coated with a fluorescent film 11, a funnel 14 which meets the panel 12 and has a neck portion 13, and an in-line electron gun 15 installed in the neck portion. The CRT further includes a deflection yoke 17 which is mounted over the cone portion 16 from the neck portion 13 of the funnel 14 and deflects an electron beam which is emitted from the electron gun 15.

As shown in FIG. 2, the electron gun 15 includes a cathode assembly 15*a* arrayed in an in-line shape for emitting thermal electrons, and a plurality of electrodes 15*b* fixed to a bead glass 15*c*. Three electron beam passing holes are formed through each of the electrodes 15*b* in an inline shape.

In the operation of the conventional color CRT having such a configuration, electron beams emitted from the electron gun 15 are selectively deflected by the deflection yoke 17 according to an image signal. Deflected electron beams land on a fluorescent film and excite the fluorescent material thereon, thereby forming a picture.

The electron gun 15 is sealed and installed in the tube-shaped neck portion 13 such that electron beam passing holes are horizontally arrayed, thus forming a difference between the horizontal deflection force of an electron beam and the vertical deflection force thereof. Also, it is preferable that the interval between the center of a middle electron beam passing hole (hereinafter, a deflection center) and the inner circumferential surface of the deflection yoke is narrowed, since a voltage to be applied to the deflection yoke can be reduced. However, since the neck portion having such a configuration has limit in narrowing the interval, a high voltage should be applied to a deflection coil of the deflection yoke to obtain a desired deflection of an electron beam.

The interval between the deflection center and the inner circumferential surface of the deflection yoke can be narrowed by reducing the diameter of the neck portion 13. However, this reduces the diameters of the electron beam passing holes formed through the electrodes of the electron gun 15, which consequently increases the spherical aberration of an electron lens which is formed by the electron beam passing holes, thus degrading the focusing characteristics of an electron beam.

In particular, about 96% of power consumed by a color CRT is consumed by the deflection yoke, among which about 71% is known to be consumed to horizontally deflect electron beams. Thus, the distance between the horizontal deflection center of the deflection yoke and the deflection center of an electron beam must be narrowed to reduce the power consumption of the deflection yoke.

Also, since the electron beam passing holes are horizontally arrayed through each of the electrodes 15*b* of the electron gun 15, the electrodes are horizontally long, such that spaces are formed on the upper and lower portions within the neck portion. These spaces increase the exhaust process time for vacuumizing upon the manufacture of a color CRT.

SUMMARY OF THE INVENTION

To solve the above problems, an objective of the present invention is to provide a funnel which can reduce unnecessary spaces within a neck portion and improve the deflection sensitivity by narrowing the interval between a deflection yoke and a deflection center.

Accordingly, to achieve the above objective, the present provides a funnel for a color cathode ray tube (CRT) including: a neck portion whose cross section is vertically long; a first cone portion which extends from the neck portion such that the cross section is vertically long as the neck portion, and is surrounded by a deflection yoke; and a second cone portion which extends from the first cone portion to be enlarged and meets a panel.

Here, the lateral surfaces of the neck portion, which are parallel to the longitudinal direction of the neck portion, are flat, and the upper and lower surfaces are curved.

According to a different aspect of the present invention, there is provided a color cathode ray tube including: a funnel including a neck portion whose cross section is vertically long, a first cone portion which extends from the neck portion such that the cross section is vertically long as the neck portion, and is surrounded by a deflection yoke, and a second cone portion which extends from the first cone portion to be enlarged and meets a panel; an electron gun which installs within the neck portion, and has a plurality of vertically-long electrodes through which electron beam passing holes are longitudinally formed with respect to the cross section of the neck portion; and a deflection yoke installed over the neck portion and the first cone portion, for deflecting electron beams which are emitted from the electron gun.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

Figure 1:
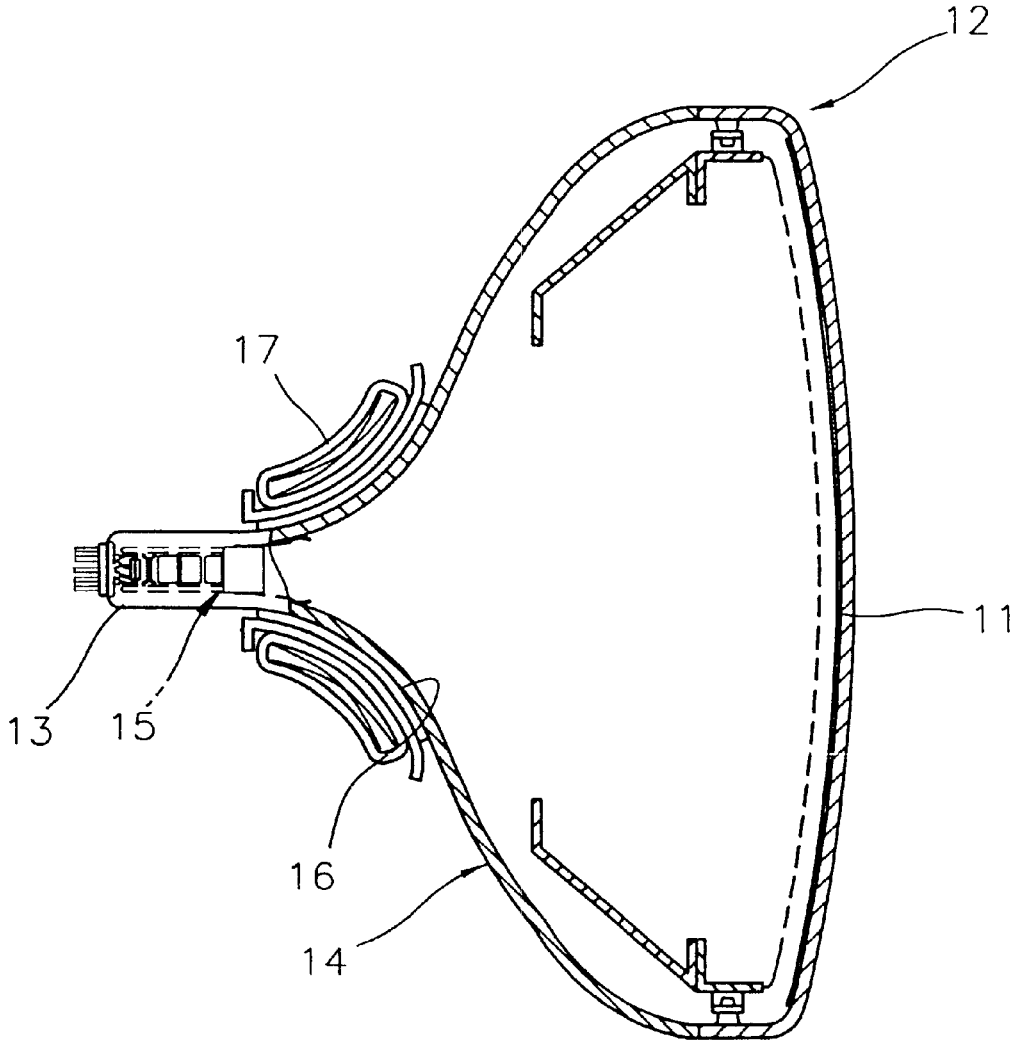
FIG. 1 (PRIOR ART)
FIG. 1 is a cross-sectional view of a conventional color cathode ray tube (CRT)
Figure 2:
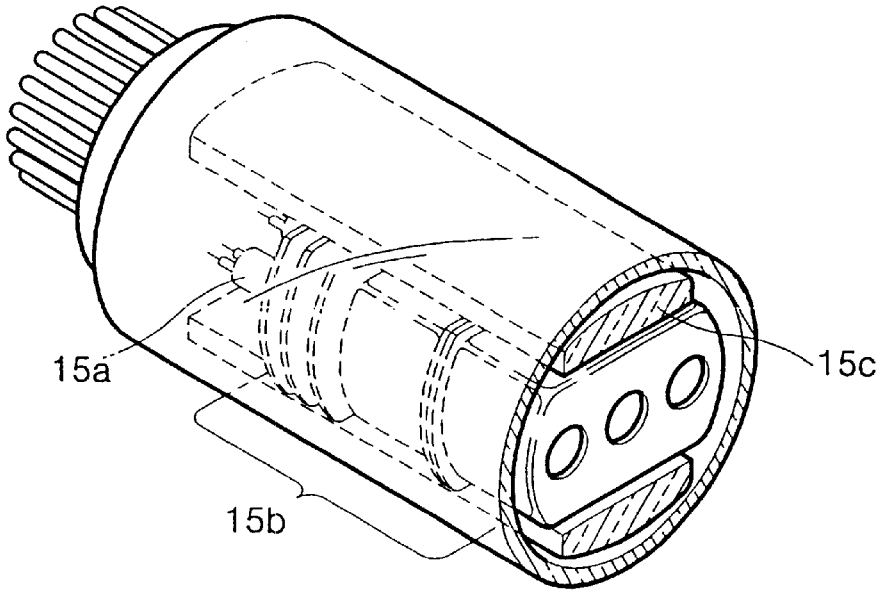
FIG.2 (PRIOR ART)
FIG. 2 is a partially cut-away perspective view of an electron gun sealed in a neck portion in the conventional color CRT.
Figure 3:
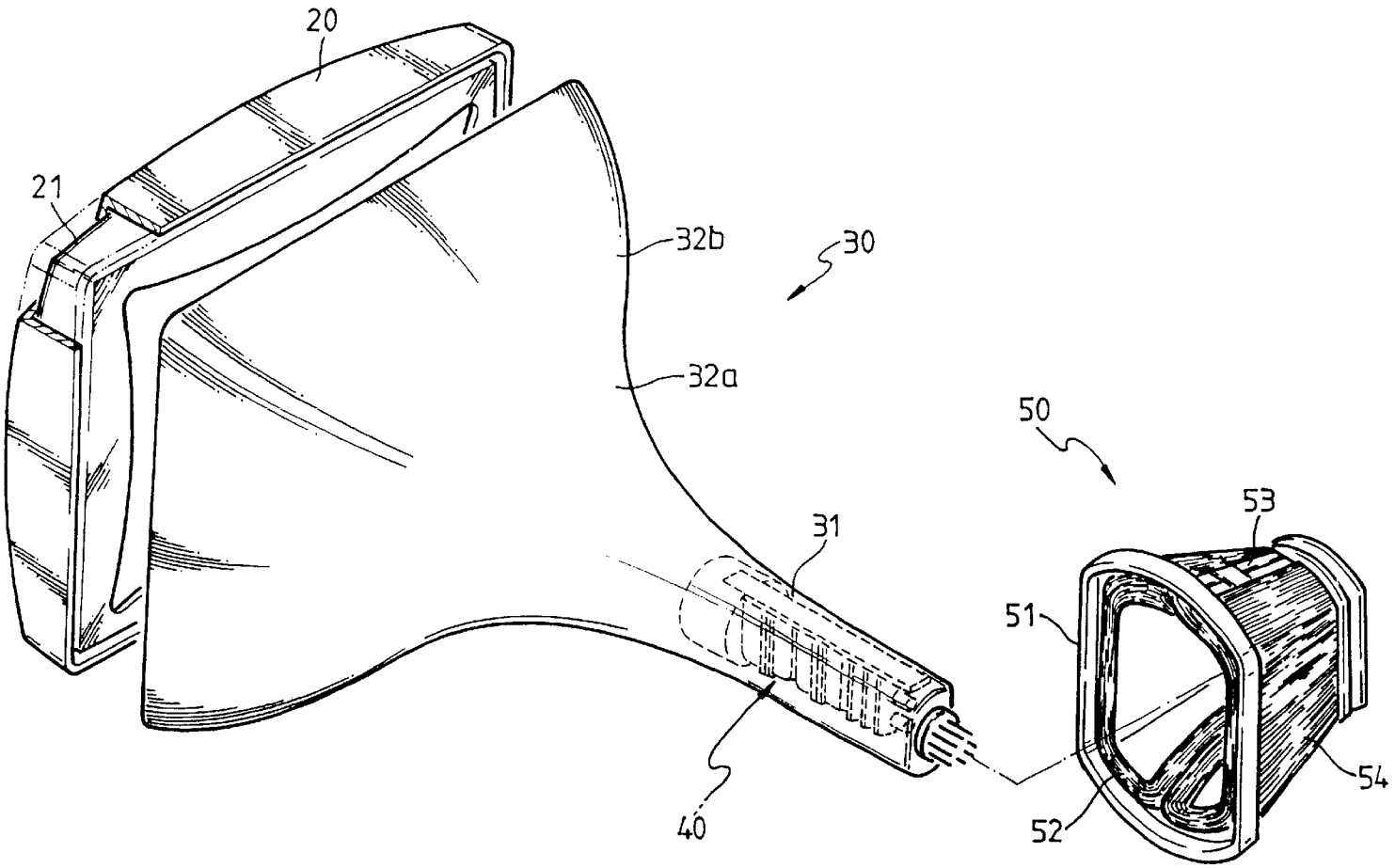
FIG. 3 is an exploded perspective view of a CRT according to the present invention.

Referring to FIG. 3, a color cathode ray tube (CRT) according to an embodiment of the present invention includes a panel 20 having a screen 21, a funnel 30 which meets the panel 20, an electron gun 40 installed in a neck portion 31 of the funnel 30, and a deflection yoke 50 fit around the funnel 30 for deflecting electron beams emitted from the electron gun.

Figure 4:
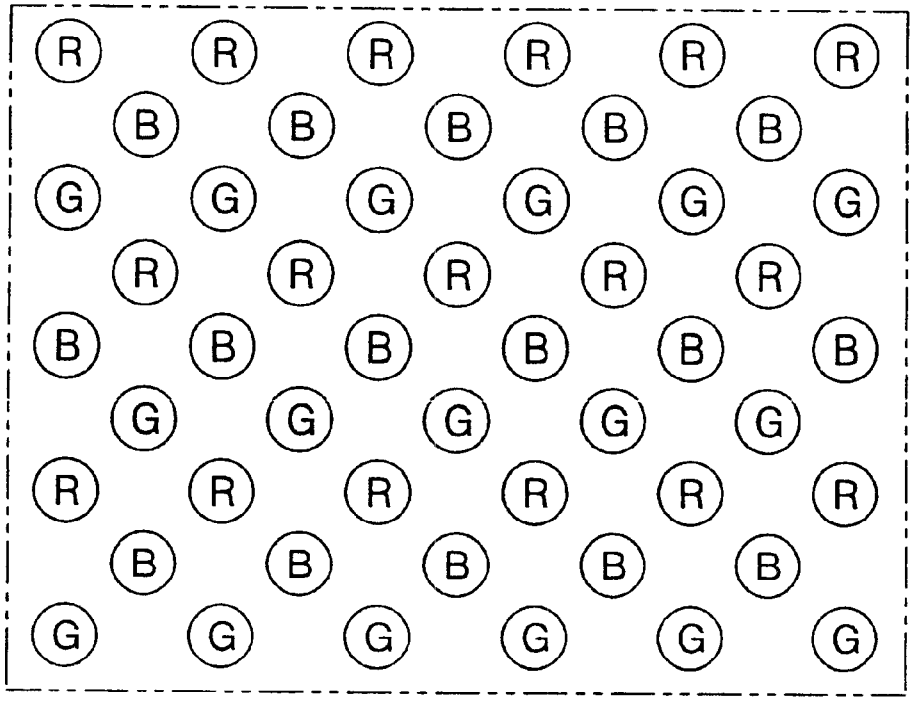
FIG. 4 shows a fluorescent pattern formed on the screen of the CRT according to the present invention shown in FIG. 3.

As shown in FIG. 4, red, green and blue fluorescent materials R, G, and B are coated in a dot shape on the screen 21. For example, an identical fluorescent material can be horizontally repeated on the screen 21, and the red, green and blue fluorescent materials can be vertically repeated thereon. However, this arrangement of the R, G and B fluorescent materials is not limited to such an embodiment, and thus fluorescent materials can be coated in stripe.

Figure 5:
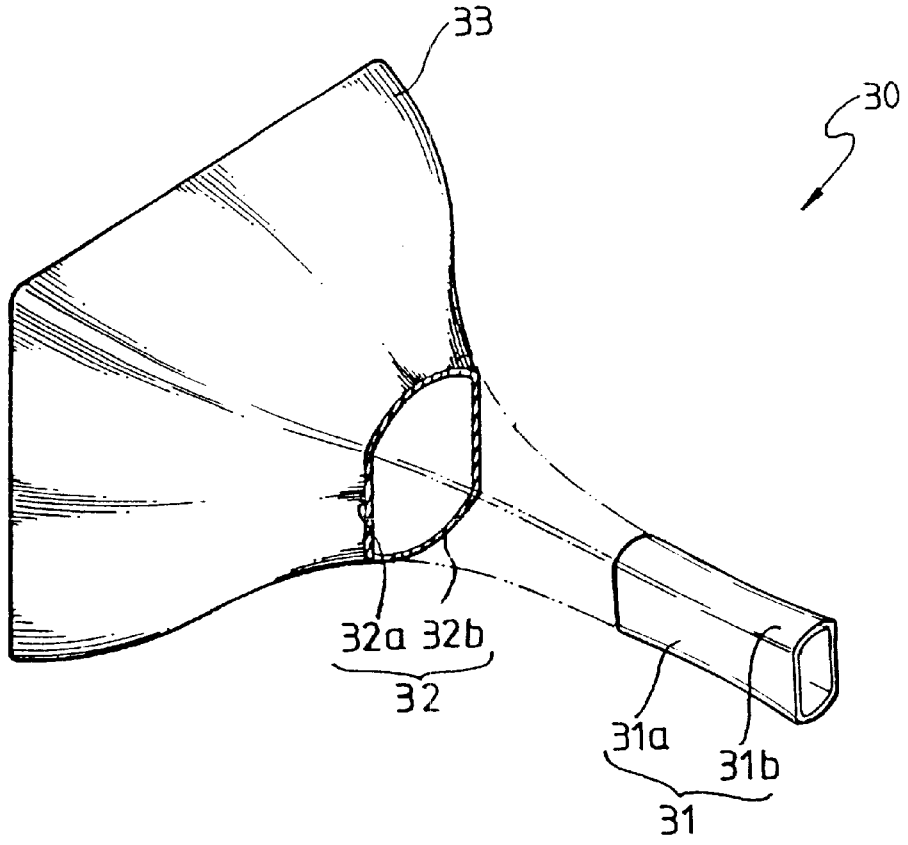
FIG. 5 is a perspective view of the funnel in the CRT according to the present invention shown in FIG. 3.

As shown in FIG. 5, the funnel 30 includes a neck portion 31, a first cone portion 32 extending from the neck portion 31 to be enlarged, and a second cone portion 33 extending from the first cone portion 32 to be more enlarged. The neck portion 31 is vertically long, in which lateral surfaces 31 a are flat and in parallel to the longitudinal direction of the cross-section of the neck portion, and the upper and lower surfaces 31*b* are curved.

The first cone portion 32 extends from the neck portion 31 to be enlarged while keeping the shape of the neck portion 31. That is, the lateral surfaces 32*a* of the first cone portion 32 are flat and parallel to each other, and the upper and lower surfaces 32*b* are curved. The shapes of the neck portion 31 and the first cone portion 32 are not limited to the present embodiment. Any shape can be adopted if its cross section is vertically long such that the deflection sensitivity can be increased.

Figure 6:
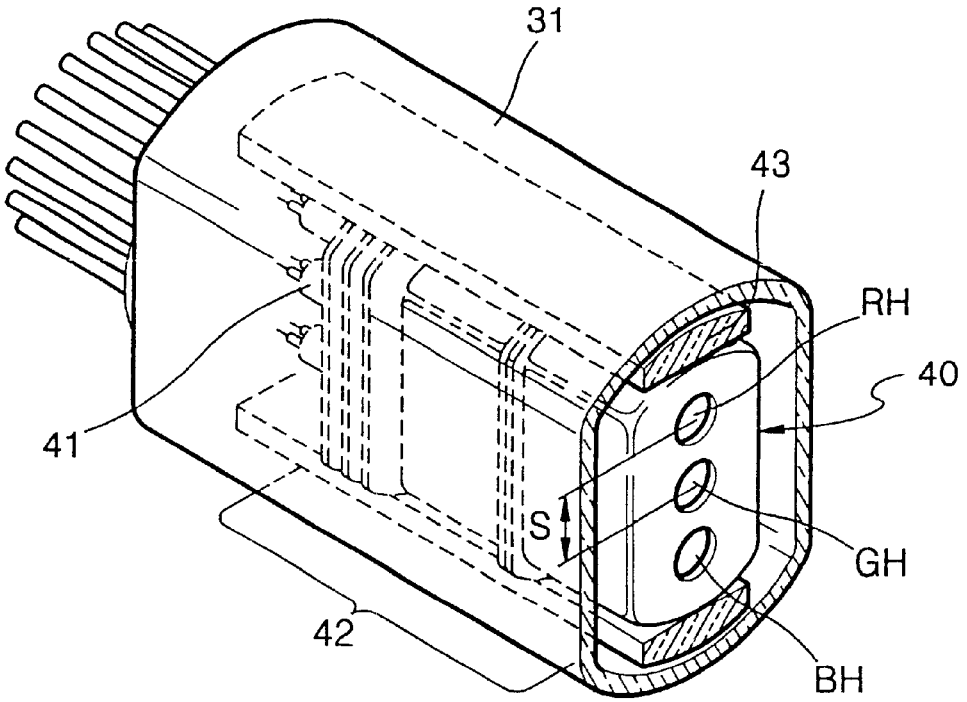
FIG. 6 is a partially cut-away perspective view of an electron gun installed in a neck portion in the CRT according to the present invention shown in FIG. 3.

As shown in FIG. 6, the electron gun 40 is installed within the neck portion 31 of the funnel, and includes three cathode assemblies 41 and vertically-long electrodes 42. The cathode assemblies 41 are vertically arrayed, that is, longitudinally arrayed with respect to the cross-section of the neck portion 31, and the vertically-long electrodes 42 are isolated predetermined intervals apart from the cathode assemblies 41. Electron beam passing holes RH, GH and BH are vertically formed through each of the electrodes 42, that is, are longitudinally formed therethrough with respect to the cross section of the neck portion 31. Bead glasses 43 are installed on and below the cathode assemblies 41 and the electrodes 42, respectively, to fix them. Preferably, the bead glasses are installed on the upper and lower portions within the neck portion 31, respectively, to be close to the red and blue electron beam passing holes RH and BH.

The deflection yoke 50 shown in FIG. 3 is installed from the neck portion 31 to the first cone portion 32, and includes a separator 51, a vertical deflection coil 52 installed on the inner surface of the separator 51, a ferrite core 53 surrounding the outer circumferential surface of the separator 51, and a horizontal deflection coil 54 wound around the ferrite core 53. The lateral surfaces of the separator 51 are flat, and the upper and lower surfaces thereof have curvatures which are the same as the curvatures of the upper and lower surfaces of the neck portion 31 and the second cone portion 32.

Electron beams, which are emitted from the electron gun 40 of the color CRT according to the present invention having such a configuration, are deflected by the deflection yoke 50, land on fluorescent materials, and excite the fluorescent materials. In this way, a picture is formed.

According to the present invention, the cross section of the neck portion 31 is vertically long, and the electrodes of the electron gun 40 having electron beam passing holes vertically formed therethrough are also vertically long, such that unnecessary spaces formed by the installation of the electron gun within the neck portion 31 can be reduced. The inner circumferential surface of the deflection yoke 50 has the same shape as the outer circumferential surfaces of the first cone portion 32 and the neck portion 31, such that the interval between the deflection center of the deflection yoke 50 and an electron beam emitted from the electron gun is reduced, which increases the deflection sensitivity caused by the deflection magnetic field of the deflection yoke 50. Such an improvement in the deflection sensitivity can lower a voltage which is applied to the deflection yoke 50 to deflect electron beams and further reduce the power consumption of the deflection yoke 50.

Generally, it is preferable that the diameter of a neck portion in which an electron gun is installed is reduced to improved the deflection sensitivity. However, the reduction of the diameter of the neck portion narrows the eccentric distance S (see FIG. 6) between adjacent electron beam passing holes formed through electrodes. In the present invention, electrodes of an electron gun are vertically arrayed, that is, longitudinally arrayed with respect to the cross section of a neck portion, within the vertically-long neck portion 31, such that narrowing of an area for forming the electron beam passing holes RH, GH and BH by reducing the diameter of the neck portion 31 to improve the deflection sensitivity can be suppressed. Therefore, the prevention of the eccentric distances between adjacent electron beam passing holes RH and GH and between GH and BH from being narrowed can reduce the spherical aberration of an electron lens, and improve the focusing characteristics of an electron beam.

What is claimed is:

1. A funnel for a color cathode ray tube (CRT) comprising:

a neck portion whose cross section is vertically long;

a first cone portion which extends from the neck portion such that the cross section is vertically long as the neck portion, and is surrounded by a deflection yoke; and a second cone portion which extends from the first cone portion to be enlarged and meets a panel.

2. The funnel for a color cathode ray tube of claim 1, wherein the lateral surfaces of the neck portion, which are parallel to the longitudinal direction of the neck portion, are flat, and the upper and lower surfaces are curved.

3. A color cathode ray tube comprising:

a funnel including a neck portion whose cross section is vertically long, a first cone portion which extends from the neck portion such that the cross section is vertically long as the neck portion, and is surrounded by a deflection yoke, and a second cone portion which extends from the first cone portion to be enlarged and meets a panel;

an electron gun which installs within the neck portion, and has a plurality of vertically-long electrodes through which electron beam passing holes are longitudinally formed with respect to the cross section of the neck portion; and a deflection yoke installed over the neck portion and the first cone portion, for deflecting electron beams which are emitted from the electron gun.

4. The color cathode ray tube of claim 3, wherein the electron gun comprises:

cathodes coaxially installed with the electron beam passing holes; and bead glasses for fixing the electrodes to the cathodes.

5. The color cathode ray tube of claim 4, wherein the bead glasses are installed on the upper and lower portions within the neck portion so that the bead glasses are close to electron beam passing holes which are near to the upper and lower sides of each of the electrodes.

6. The color cathode ray tube of claim 3, wherein the deflection yoke comprises:

a separator of which lateral surfaces corresponding to the lateral surfaces of each of the neck portion and the cone portion are flat, and upper and lower surfaces are curved;

a vertical deflection coil installed on the inner surface of the separator;

a ferrite core which surrounds the outer circumferential surface of the separator; and a horizontal deflection coil wound around the ferrite core.

* * * * *